US007410318B2

(12) United States Patent
Chambers et al.

(10) Patent No.: US 7,410,318 B2
(45) Date of Patent: Aug. 12, 2008

(54) BACK APPLICATOR

(76) Inventors: Griselda E. Chambers, 8081 Willowick Ct., Colorado Springs, CO (US) 80925; Robert E. Chambers, 8081 Willowick Ct., Colorado Springs, CO (US) 80925

( * ) Notice: Subject to any disclaimer, the term of this patent is extended or adjusted under 35 U.S.C. 154(b) by 4 days.

(21) Appl. No.: 11/494,336

(22) Filed: Jul. 27, 2006

(65) Prior Publication Data

US 2008/0025783 A1 Jan. 31, 2008

(51) Int. Cl.
*A46B 5/02* (2006.01)
*B08B 1/00* (2006.01)

(52) U.S. Cl. ..... 401/8; 401/6; 15/104.94

(58) Field of Classification Search ..... 401/6, 401/8, 207; 15/104.93, 104.94
See application file for complete search history.

(56) References Cited

U.S. PATENT DOCUMENTS 5,035,523 A * 7/1991 Allinder ..... 401/6
5,386,609 A * 2/1995 Xenos ..... 15/222
5,983,436 A * 11/1999 Mason et al. ..... 15/222
6,026,531 A * 2/2000 Pruitt ..... 15/160
6,129,469 A 10/2000 Messer et al.
6,280,108 B1 8/2001 Haining et al.
6,325,564 B1 12/2001 Knowles

* cited by examiner

*Primary Examiner*—David J Walczak
(74) *Attorney, Agent, or Firm*—Dale J. Ream

(57) ABSTRACT

A back applicator enables a user to apply lotion to his own back or multiple users to apply lotion in succession in a sanitary manner. The back applicator includes a base plate and first and second straps coupled to opposed sides thereof and extending in opposed directions. At least one of the straps is length adjustable such that the length of the applicator device may be selectively changed. The back applicator also includes an applier that is selectively and removably coupled to the base plate. The applier may be a sponge to which a lotion may be applied or that may be pro-loaded with lotion. The applier may include a clip having resilient members complementary to an opening defined by the base plate such that the applier may be attached to the base plate, used, and then disposed of after lotion has been applied.

5 Claims, 2 Drawing Sheets

BACK APPLICATOR

BACKGROUND OF THE INVENTION

This invention relates generally to applicator devices and, more particularly, to an applicator for enabling a person to efficiently and sanitarily apply lotion to his own back.

There are many situations in which a person may desire to apply various types of lotion to his back. For example, a person may desire to apply suntan lotion to his back when at the beach, swimming pool, or sunbathing in another location. Or, a person may desire to apply insect repellant to his back and other body locations when in an outdoor environment at night or in a vegetative environment that is thick with insects. And, of course, applying skin moisturizing lotion while in the shower or immediately after showering is a common desire.

Various brushes and applicators are known in the art. Although assumably effective for their intended purposes, there is still a need for an applicator that enables a user to apply various lotions to his own back or for multiple users to successively apply lotions to their backs in a sanitary manner.

Therefore, a general object of this invention is to provide a back applicator that enables a user to conveniently apply a lotion to his own back without assistance.

Another object of this invention is to provide a back applicator, as aforesaid, that may be used by multiple users in succession in a sanitary manner.

Still another object of this invention is to provide a back applicator, as aforesaid, that uses sponges that may be removed and disposed of after every use.

Yet another object of this invention is to provide a back applicator, as aforesaid, having an adjustable length so as to be used by persons of different sizes.

A further object of this invention is to provide a back applicator, as aforesaid, having opposed handles for secure grasping by a user.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A back applicator 100 according to the present invention will now be described in detail with reference to FIGS. 1 through 2*b* of the accompanying drawings. More particularly, a back applicator 100 according to the current invention includes a base plate 110, at least one strap 120, and an applier 130.

Figure 1:
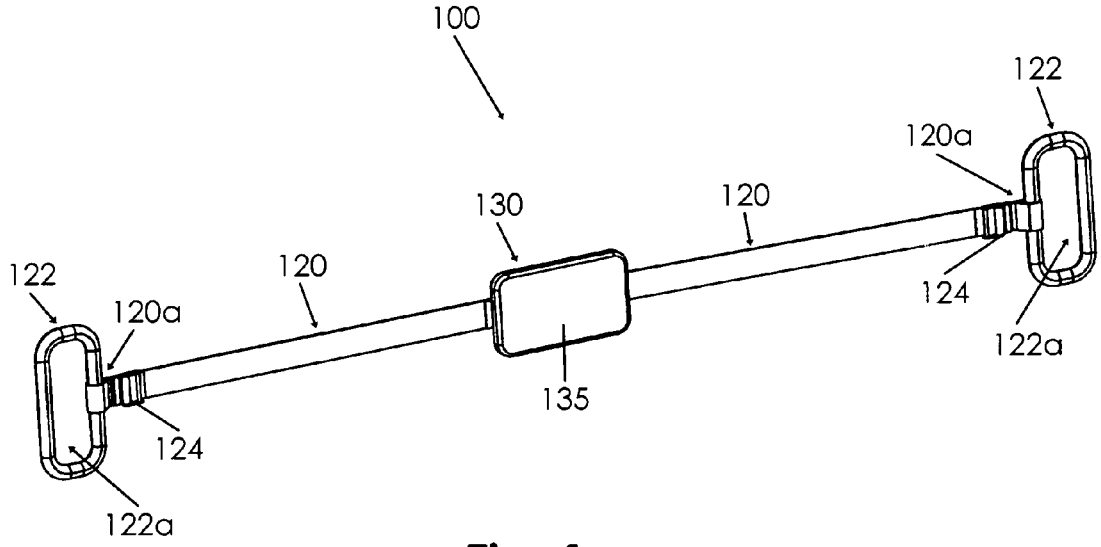
FIG. 1 is a front perspective view of a back applicator according to a preferred embodiment of the present invention.
Figure 2A:
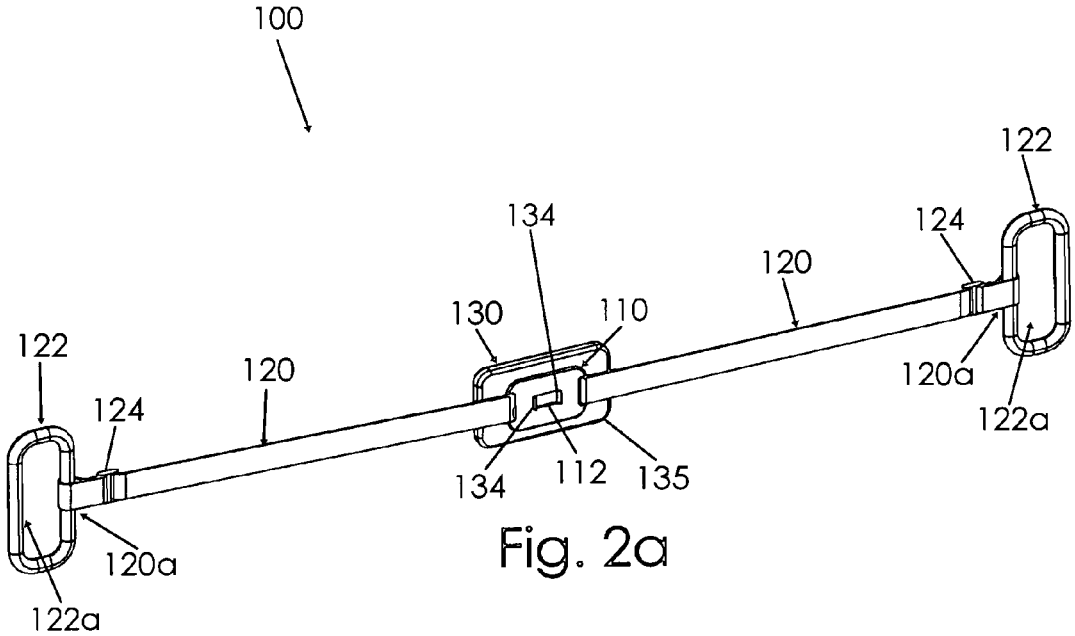
FIG. 2*a* is rear perspective view of the back applicator as in FIG. 1.
Figure 2B:
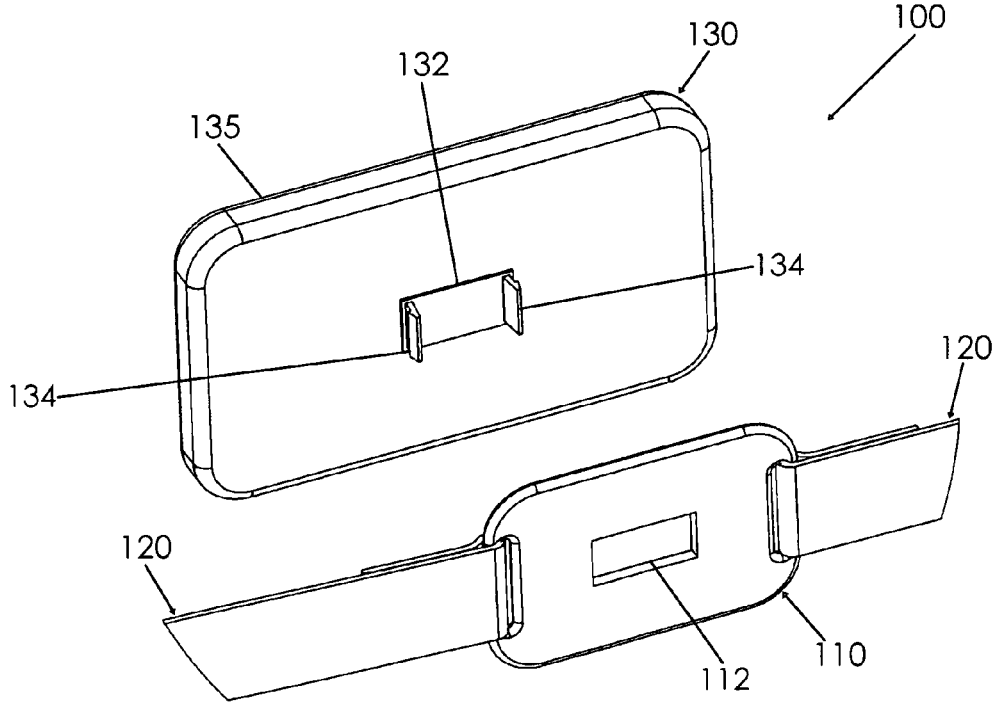
FIG. 2*b* is an exploded view of the back applicator as in FIG. 2*a*.

As shown in FIG. 1, first and second straps 120 extend in opposed directions from the base plate 110. Though not shown, a single strap 120 may be used instead of two distinct straps 120. Handles 122 may be included at outer ends 120*a* of the straps 120, and each handle 122 may define an interior area 122*a* for receiving a hand. Means for adjusting at least one of the straps 120 may be included, such as a strap adjustor 124 or another strap-adjusting device. A strap adjustor 124 may be situated along both straps 120 to selectively adjust a length of each strap 120 independently.

The applier 130 is removably coupled to the base plate 110. As shown in FIG. 2*b*, the base plate 110 may define an opening 112, and the applier 130 may have a clip 132 having a configuration that is complementary to the opening 112 for selectively coupling the applier 130 to the base plate 110. The clip 132 may have opposed resilient members 134, as shown in FIG. 2*b*, or other structure may alternately be used. The applier 130 may include a sponge 135 or another material appropriate for spreading lotions, and the sponge 135 may or may not include a pre-applied lotion. Various sponges 135 may have various types of lotions, such as suntan lotion, body lotion, insect repellant, etc.

In use, the applier 130 may be coupled to the base plate 110, such as by passing the clip 132 through the opening 112 in the base plate 110. The length of the straps 120 may be adjusted by using the strap adjustors 124. If the sponge 135 does not include a lotion, a lotion or another substance may be introduced to the sponge 135. A user may hold each handle 122 and maneuver the sponge 135 across his back to spread a lotion or another substance on the sponge 135 uniformly across his back. Once the lotion has been applied, the applier 130 may be removed from the base plate 110 (i.e., by squeezing the resilient members 134 and passing the clip 132 back through the opening 112 in the base plate 110) and discarded. The straps 120 may then be folded to make the back applicator 100 easy to store. Disposal of the used sponge and then subsequent attachment of a fresh one enables successive uses of the back applicator 100 to be sanitary as well as to minimize the inconvenience of having to clean the sponge between uses.

It is understood that while certain forms of this invention have been illustrated and described, it is not limited thereto except insofar as such limitations are included in the following claims and allowable functional equivalents thereof.

What is claimed is:

1. A back applicator, comprising:

a base plate defining a single opening;

first and second distinct straps extending in opposite directions from said base plate wherein each of said straps has a first end attached to an end of said base plate whereby said single opening is positioned between said first ends of said straps;

an applier removably coupled to said base plate;

wherein:

at least one of said first and second straps is length adjustable;

said applier includes a clip having ac onfiguration complementary to a configuration of said base plate opening for selectively coupling said applier said base;

said clip includes opposed resilient members that are squeezeable to selectively move said clip through said opening; and said applier includes a sponge having a lotion pre-applied thereon.

2. The back applicator of claim 1, further comprising handles at outer ends of said first and second swaps.

3. The back applicator of claim 2, wherein each said handle defines an interior area for receiving a hand.

4. The back applicator of claim 1, further comprising a strap adjustor situated along said first strap to selectively adjust a length of said first strap.

5. The back applicator of claim 1, further including means for adjusting at least one of said first and second straps.

* * * * *

UNITED STATES PATENT AND TRADEMARK OFFICE

CERTIFICATE OF CORRECTION

PATENT NO. : 7,410,318 B2
APPLICATION NO. : 11/494336
DATED : August 12, 2008
INVENTOR(S) : Griselda E. Chambers and Robert E. Chambers It is certified that error appears in the above-identified patent and that said Letters Patent is hereby corrected as shown below:

Col. 2 line 57, in claim 2, change the last word "swaps" to --straps--.

Signed and Sealed this

Fourteenth Day of October, 2008

JON W. DUDAS
*Director of the United States Patent and Trademark Office*